United States Patent [19]

Zalewski

[11] 4,437,201

[45] Mar. 20, 1984

[54] SOOT BLOWER

[75] Inventor: Gerald F. Zalewski, Erie, Pa.

[73] Assignee: White Consolidated Industries, Inc., Cleveland, Ohio

[21] Appl. No.: 321,276

[22] Filed: Nov. 13, 1981

[51] Int. Cl.[3] ..... F23J 3/02

[52] U.S. Cl. ..... 15/316 R

[58] Field of Search ..... 15/316 R, 316 A, 317, 15/318

[56] References Cited

U.S. PATENT DOCUMENTS

| | | | |
|---|---|---|---|
| 2,585,776 | 2/1952 | Hermanek | 19/109 |
| 2,604,358 | 7/1952 | Richards | 299/47 |
| 2,932,053 | 4/1960 | McColl | 15/317 |
| 3,230,568 | 1/1966 | Saltz | 15/317 |
| 3,439,376 | 4/1969 | Nelson et al. | 15/317 |
| 4,165,552 | 8/1979 | Johnston, Jr. | 15/312 |
| 4,207,648 | 6/1960 | Sullivan et al. | 15/316 R |

FOREIGN PATENT DOCUMENTS

| | | | |
|---|---|---|---|
| 203041 | 5/1956 | Australia | 17.2/3.4 |

OTHER PUBLICATIONS

Manual for "F" Type Carter Hydraulic Variable Speed Gears.

*Primary Examiner*—Chris K. Moore

*Attorney, Agent, or Firm*—Mandeville & Schweitzer

[57] ABSTRACT

The invention is directed to a soot blower for cleaning the interior surfaces of a boiler by discharging a suitable cleaning fluid from a nozzle against such surfaces. The soot blower includes a novel drive system operable both as the horizontal drive for the traveling carriage of the soot blower and as an independently controllable rotary drive for rotating the lance tube of the soot blower. The horizontal drive for the traveling carriage is associated with a motor means whereby operation of the motor means energizes the horizontal drive to advance and retract along a predetermined horizontal path of travel. The rotary drive for rotating the lance tube is mounted on the traveling carriage and is mechanically coupled to the motor means through the horizontal drive whereby operation of the motor provides a driving input for the rotary drive. Pursuant to a significant feature of the invention, the rotary drive includes independent control means for controlling the rotational velocity and direction of the lance tube independently of the speed and direction of travel of the traveling carriage along the predetermined horizontal path of travel.

26 Claims, 15 Drawing Figures

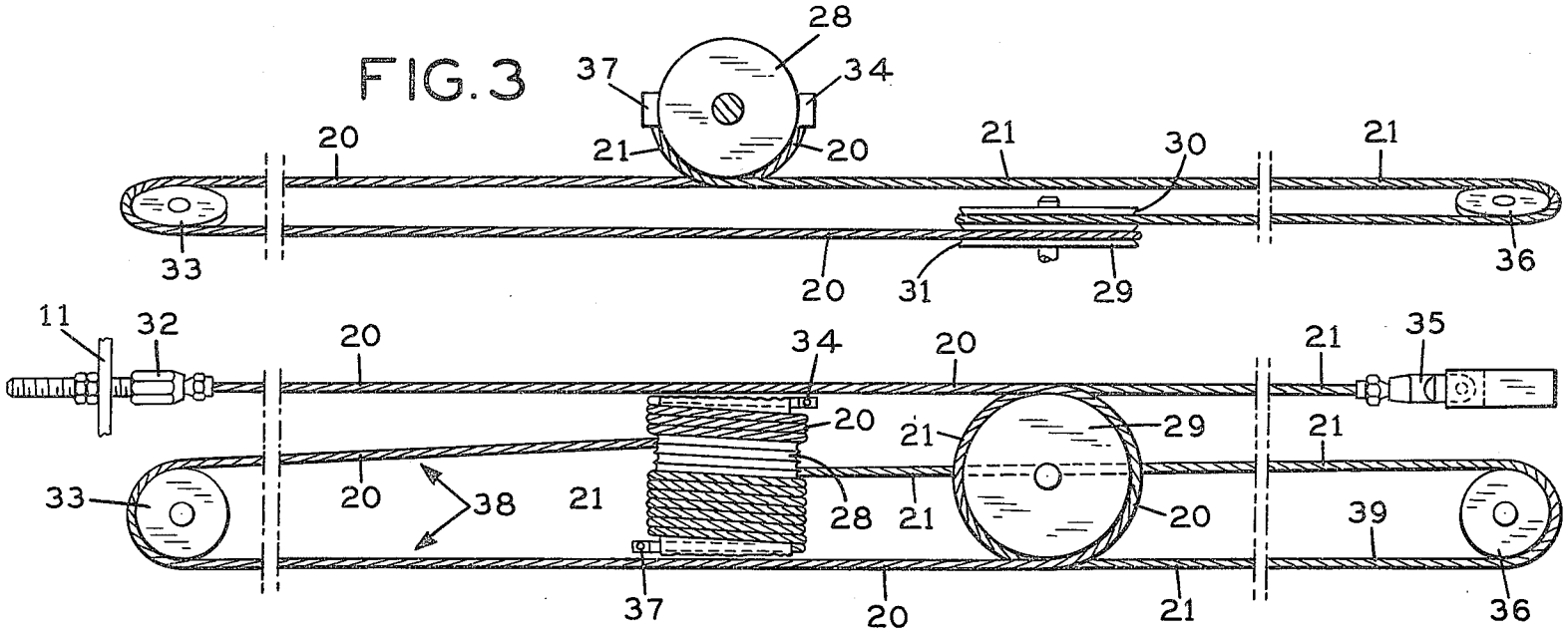
FIG. 3
FIG. 4
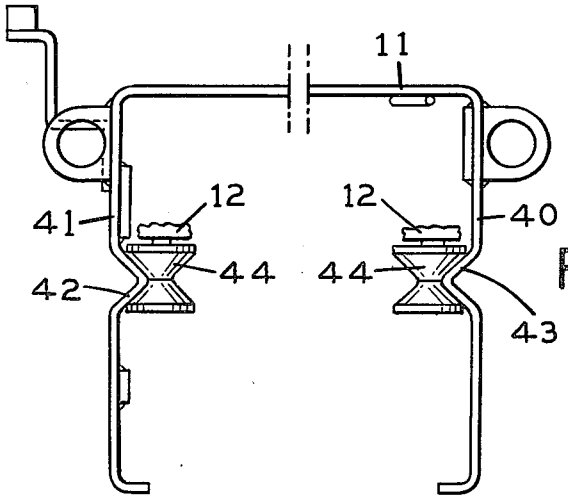
FIG. 6

SOOT BLOWER

BACKGROUND AND SUMMARY OF THE INVENTION

The invention is directed to a soot blower for cleaning the interior surfaces of a boiler by discharging a suitable cleaning fluid from a nozzle against such surfaces. More particularly, the invention relates to a new and improved drive means for imparting horizontal and rotational motion to a lance tube mounting the fluid discharge nozzle.

Typically, in a soot blower of the long retracting or recovery type, a lance tube is moved through various long paths of travel horizontally forward into the heat exchange zone of a large public utility boiler or a pulp and paper mill recover boiler and thereafter retracted to its original starting position. During the traveling motion of the lance tube, the tube is rotated about its longitudinal axis and a cleaning fluid is discharged through a nozzle mounted at the forwardmost end of the tube so that the fluid may be directed against various internal surfaces of the boiler to remove undesirable soot accumulations. Accordingly, various means are required for imparting both linear and rotational movement to the lance tube during the traveling motion of a complete cleaning cycle. To advantage, the lance tube is rotatably supported by a traveling carriage which is, in turn, movably mounted within a housing channel arranged adjacent the public utility boiler.

The prior art has proposed many mechanical expedients, both automatic and manually operable, to drive the traveling carriage and to utilize a portion of the drive input for the traveling carriage as a rotary drive for rotating the lance tube. Such prior proposals have included chain or cable drives, rack-and-pinion arrangements and electric motors mounted on the traveling carriage. However, while the prior proposals have proven to be generally effective in achieving the intended purpose, they have been limited in providing efficient operation with maximum independent control for each of the horizontal and rotational movements of the lance tube.

It is a primary objective of the present invention to provide a novel drive system operable both as the horizontal drive for the traveling carriage and as a variable and reversible rotary drive for rotating the lance tube. In accordance with a significant feature of the invention, a variable, reversible rotational drive means, including, for example, either a hydrostatic drive, changeable gear train or both is mounted on the traveling carriage and includes a mechanical coupling with the lance tube whereby the output of the variable rotational drive means is utilized as the rotary drive to the lance tube. The horizontal drive for the traveling carriage is coupled to the rotary drive means so as to provide the necessary input drive for rotation of the lance tube. Accordingly, the rpm of the reversible, variable rotary drive means output may be selectively set within a predetermined range and the rotary direction of the drive output controlled at a pre-selected time during the working motion of the lance tube to provide a rotary motion whose components are controllable independently from the direction and magnitude of the horizontal drive. In this manner, the rotational speed and direction of the cleaning fluid discharged from the nozzle of the lance tube are precisely set to obtain the most effective cleaning action possible under the circumstances existing in a particular boiler while advantageously utilizing the horizontal carriage drive as the energy source for the rotary drive.

In accordance with a preferred embodiment for the rotary drive, a changeable gear train is mechanically coupled to the horizontal traveling carriage drive. The gear combinations of the gear train are selectively changeable to achieve a desired rotational velocity for the lance tube in view of the predetermined horizontal velocity of the traveling carriage. The rotary drive is controlled by means of a novel reversing mechanism whereby the direction of rotation of the lance tube may be pre-selected irrespective of the driving direction imparted to the rotary drive means during the advancing and retracting portions of the cleaning cycle by the horizontal drive means, as will appear.

Pursuant to another embodiment of the invention, maximum efficiency and control in the operation of the soot blower is achieved by utilizing a hydrostatic drive as the variable rotational drive means. The horizontal motion of the traveling carriage is used additionally as a source of input power for the hydrostatic drive. Inasmuch as the lance tube is necessarily moved along a horizontal path of travel to transport the cleaning fluid discharge nozzle through the full width of the boiler, a portion of the horizontal drive energy or the traveling momentum of the carriage may be selectively coupled to the hydrostatic drive input. Morover, the hydrostatic drive includes control means whereby the output direction of the drive is controllable and the velocity infinitely variable between predetermined limits.

To best advantage, the present invention provides a novel cable drive system operable to achieve a reliable, controllable horizontal motion for the traveling carriage. The cable drive system is coupled to the rotary drive of the lance tube by a suitable pulley rotatably mounted on the traveling carriage whereby the pulling action of the cable drive to impart horizontal motion to the traveling carriage tends to rotate the pulley thereby driving the rotary drive. Thus, a single power source is utilized to energize both the cable drive, and through the cable drive, the rotary drive for the lance tube. As discussed, the variable control feature of the rotary drive permits an independent control of the rotational velocity of the lance tube irrespective of the particular horizontal speed selected for the traveling carriage. The rotary drive may be operated to provide a desired rotational velocity with appropriate adjustments being made through the control means of the hydrostatic drive and/or by an appropriate adjustment to the changeable gear train to compensate for faster or slower horizontal speeds of the traveling carriage. The rotational direction of the lance tube is also selectively controlled so that a desired nozzle rotation is achieved in accordance with changes in the rotational direction of the input pulley.

For example, it has been found to be advantageous for effective cleaning to provide a unidirectional nozzle rotation during the entire cleaning cycle. However, utilization of the horizontal drive cables results in a change of input drive direction when the traveling carriage is retracted after the forward movement. Pursuant to the invention, the rotary direction of lance tube be maintained constant by in effect "reversing" the rotary drive to cancel out the effect of changing cable drive direction. Thus, the single power source may be used for maximum efficiency without any sacrifice in independent control for each of the horizontal velocity of the traveling carriage and the rotational velocity of the lance tube. In addition to the independent control for each of the components of cleaning fluid discharge nozzle motion, the novel cable drive and rotary drive apparatuses of the present invention each afford reliable, straightforward means for achieving lance tube motion during a cleaning cycle.

As another significant feature of the invention, the housing channel of the soot blower is formed to include a track-forming 90° bend in each of the side walls of the channel. The traveling carriage is provided with rollers which are arranged and configured to engage the track-forming bends of the housing channel to support the traveling carriage for horizontal movements within the channel. The track-forming bends eliminate the need for additional structural components such as L-shaped bars to form the tracks and greatly reduce the cost and complexity in fabricating the housing channel. The track-forming bends may be formed in a simple bending operation during the time the housing channel is formed and there is no need to mount L-shaped bars to the housing channel after fabrication thereof. Thus, the track-forming bend feature of the invention provides an effective, yet inexpensive means for mounting the traveling carriage within the housing.

The present invention therefore provides several features which greatly enhance the ability of a soot blower to properly dislodge undesirable soot accumulations from the internal surfaces of large public utility boilers. The cable drive system affords a straightforward transverse drive for the traveling carriage while being ideally suited as an input for the variable rotary drive of the lance tube. The variable, reversible rotary drive in turn effectively utilizes the driving energy of the cable system while allowing independent control for the rotational velocity and direction of the lance tube.

For a better understanding of the above and other features and advantages of the invention, reference should be made to the following detailed description of a preferred embodiment of the invention and to the accompanying drawings.

BRIEF DESCRIPTION OF THE DRAWINGS

FIG. 3 is a side view in schematic form of the cable drive arrangement of the soot blower of FIGS. 1 and 1A.

FIG. 4 is a top view in schematic form of the cable drive system of FIG. 3.

FIG. 6 is an end cross sectional view of a housing channel built in accordance with the teachings of the present invention.

DETAILED DESCRIPTION OF PREFERRED EMBODIMENTS OF THE INVENTION

Figure 1:
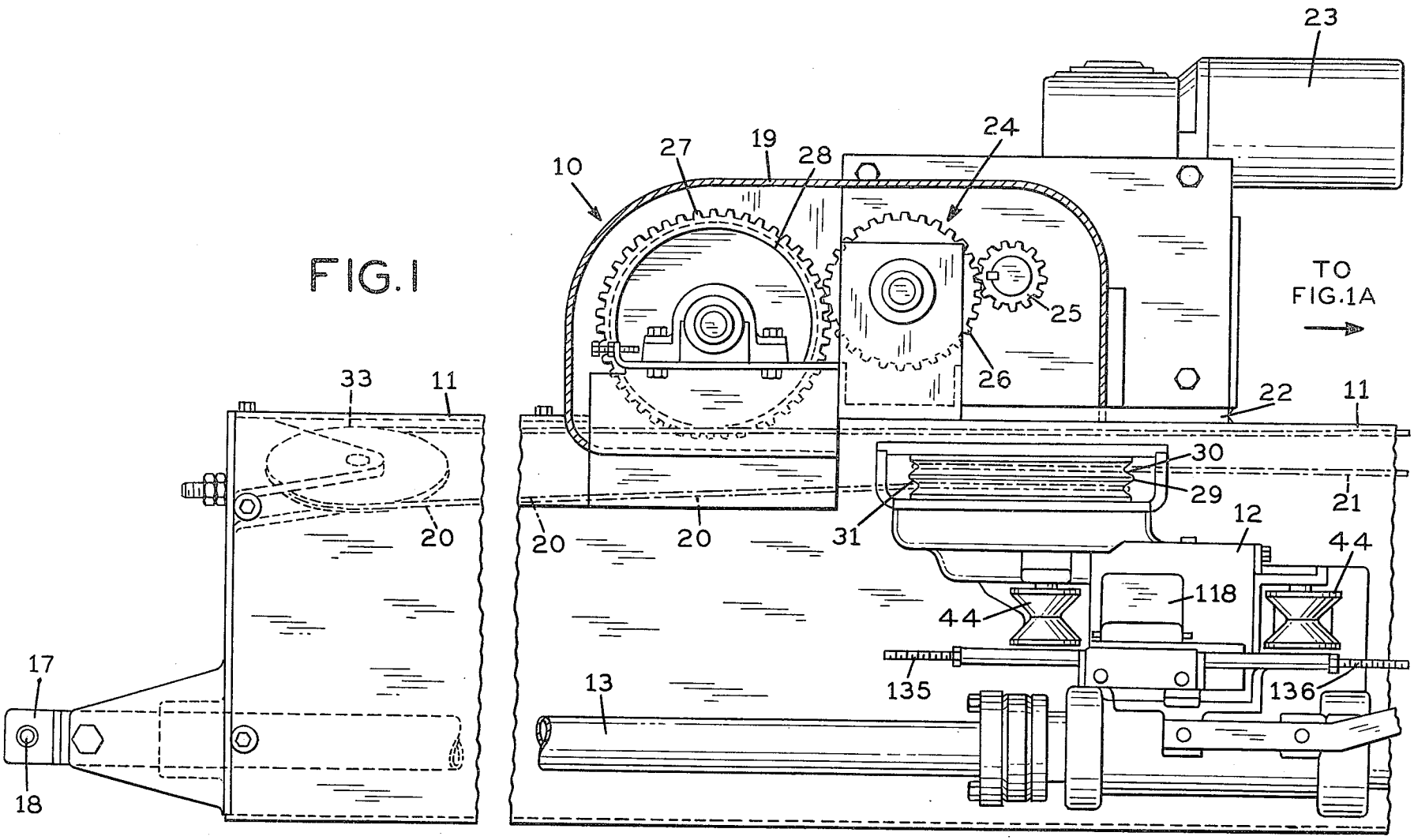
FIGS. 1 and 1A, taken together, illustrate a side view of a soot blower assembly incorporating the teachings of the present invention.
Figure 1A:
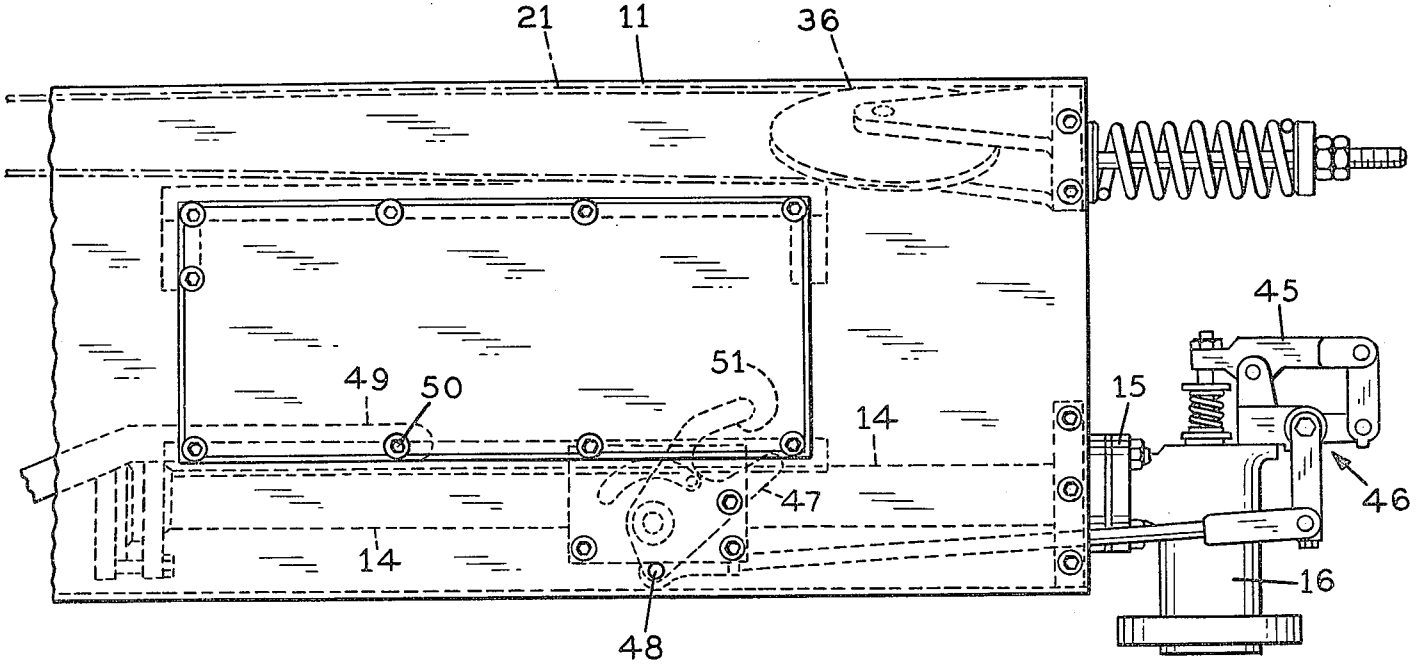
Figure 2:
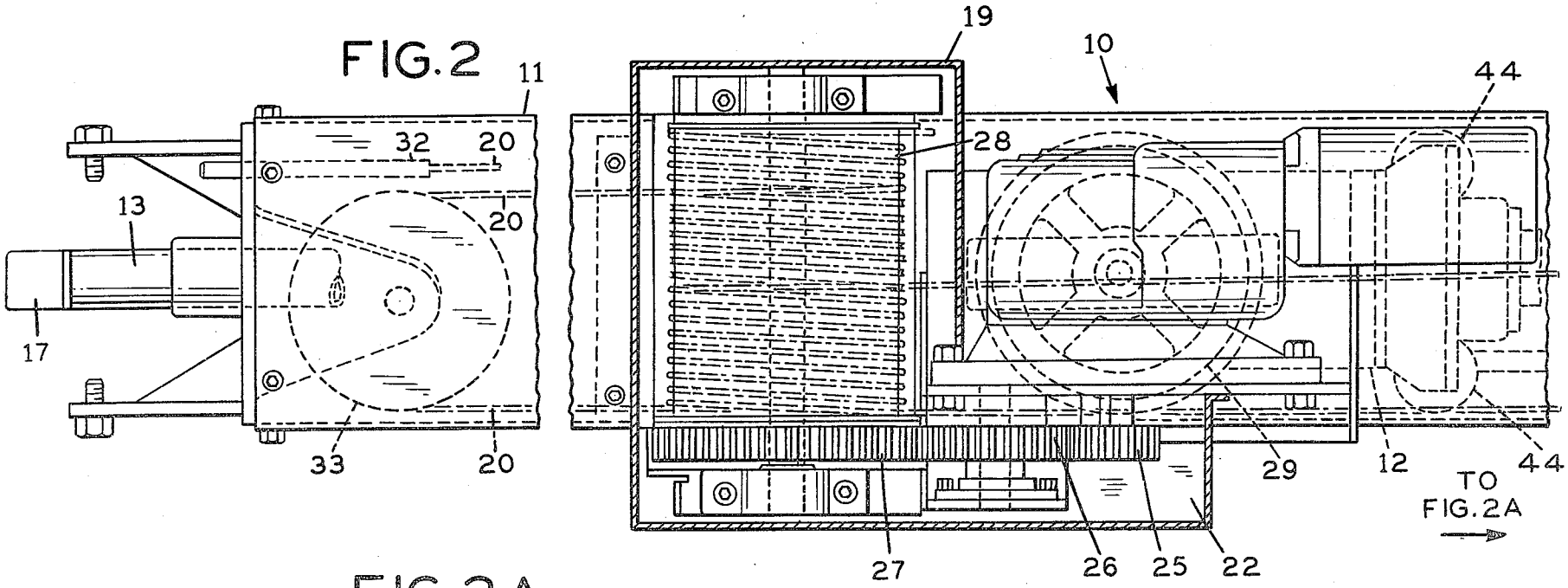
FIGS. 2 and 2A together provide a plan view of the soot blower arrangement of FIGS. 1 and 1A.
Figure 2A:
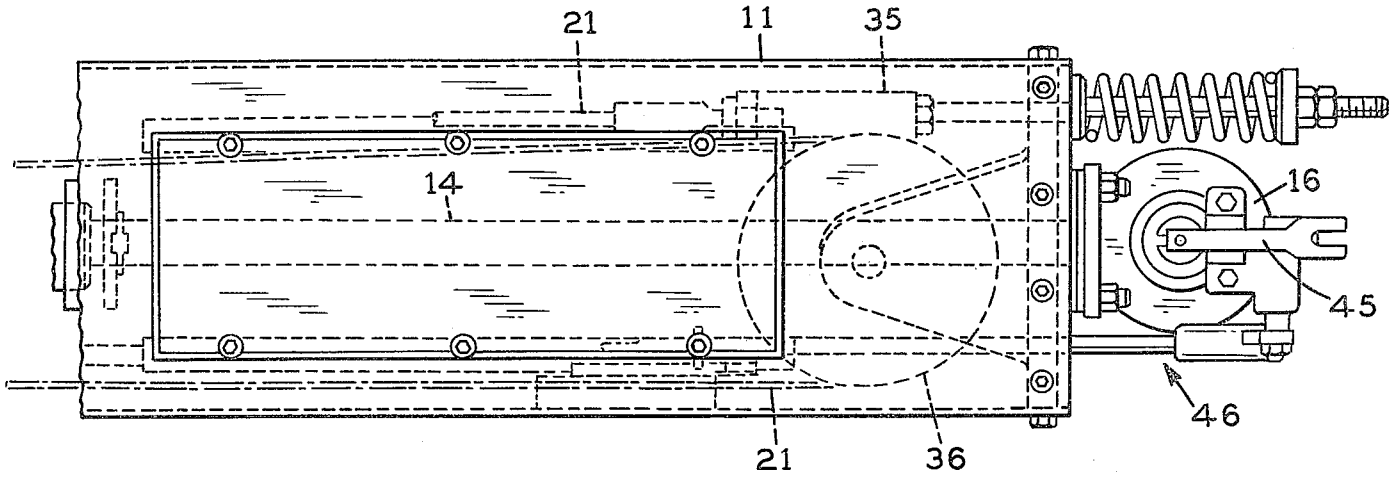

Referring now to the drawings and initially to FIGS. 1 and 1A, there is illustrated a soot blower indicated generally by the reference numeral 10. The soot blower 10 includes a main support frame 11 which defines a long housing-type channel to mount a horizontally movable traveling carriage 12, as will appear. The traveling carriage 12 in turn rotatably supports a long, hollow, rotatable lance tube 13 such that horizontal movements of the carriage 12 will advance the lance tube 13 through a working motion and return. A hollow feedpipe 14 is arranged in a co-axial, telescoping relation with the lance tube 13 and includes an end 15 in a fluid communication with the outlet passage of a valve 16. As will be discussed below, the valve 16 is operable to discharge a cleaning fluid such as air, steam and/or water through the feedpipe 14 and into the lance tube 13. The lance tube 13 includes a cleaning fluid discharge nozzle 17 mounted to the forwardmost end thereof whereby the cleaning fluid flowing through the lance tube 13 is discharged through an opening 18 formed in the nozzle 17 against the various internal surfaces of a public utility boiler to dislodge undesirable accumulations of soot therefrom. The housing 11 is mounted adjacent the heat exchange portion of the public utility boiler (not specifically illustrated) in a well known manner with the lance tube 13 being arranged and configured to travel from the housing 11 into the interior of the boiler. During the horizontal movement of the lance tube 13, the tube 13 is rotated and the valve 16 is opened so that the cleaning fluid is discharged through the nozzle 17 and follows a generally helical path for an effective cleaning operation.

Referring now to FIG. 6, the housing 11 includes two side walls 40, 41 with each of the side walls 40, 41 being formed to include a track-forming, 90° bend 42, 43 which extends the full length of the channel defind by the housing 11. A plurality of rollers 44 is rotatably mounted on the traveling carrige 12 whereby two of the rollers 44 are mounted on each side of the traveling carriage 12 (see FIGS. 1, 1A, 2, 2A). Each of the rollers 44 is formed to include a generally concave surface and the rollers 44 are arranged and configured to mate with a complementary track-forming bend 42, 43 to movably support the traveling carriage 12 within the housing.

In accordance with the invention, horizontal motion is imparted to the traveling carriage 12 by a cable drive system generally comprising a cable drive assembly 19 and first and second drive cables 20, 21 (see FIGS. 1, 1A). The cable drive assembly 19 is supported on a platform 22 which is mounted to the top of the housing 11 at a position generally mid-way between the forwardmost and rearwardmost ends of the housing 11. The drive assembly 19 comprises a reversible electric motor 23 which is mechanically coupled through a gear train 24 including gears 25, 26, 27 to a rotatable drum 28. The gear 27 is fixedly attached to one end of the rotatable drum 28 whereby operation of the reversible motor 23 will rotate the drum 28 in the clockwise or counter-clockwise direction depending on the selected mode of operation of the reversible motor 23.

Referring now more particularly to FIGS. 3 and 4, a pulley 29, rotatably mounted on the traveling carriage 12, as will appear, includes cable-receiving grooves 30, 31. The first drive cable 20 has an end fastened to a cable clamp 32 which is mounted to the forwardmost end of the housing 11 and extends from the clamp 32 around the groove 31 of the carriage pulley 29 to an end pulley 33 rotatably mounted to the forwardmost end of the housing 11. The cable 20 continues from the end pulley 33 to the drum 28 where it passes under the drum 28 through several complete turns to a cable clamp 34.

In a similar manner, the second drive cable 21 has an end fastened to a cable clamp 35 mounted to the rearwardmost end of the housing 11 and extends from the clamp 35 around the groove 30 of the carriage pulley 29 to an end pulley 36 mounted adjacent the clamp 35. The cable 21 continues from the pulley 36 under the drum 28 and through several complete turns around the drum 28 to a cable clamp 37. The above-described arrangement of the drive cables 20, 21 forms two cable loops 38, 39 between the end pulleys 33, 36 and the carriage pulley 29, with one loop 38, 39 arranged on each side of the traveling carriage 12.

As should be understood, rotation of the cable drum 28 will act to take up one of the cables 20, 21 and unwind the other cable 20, 21 and thereby cause the effective lengths of the cable loops 38, 39 to change. The length of the loop defined by the cable being taken up by the drum 28 will decrease while the length of the loop defined by the cable being unwound from the drum 28 will increase. Inasmuch as each of the cables 20, 21 is clamped at both ends by cable clamps 32, 34, 35, 37, respectively, the traveling carriage 12 will move along the horizontal path of travel defined by the track-forming bends 42, 43 to accommodate the changing loop lengths. In this manner, the lance tube 13 may be selectively advanced and retracted from the housing 11 in a cleaning cycle by operation of the motor 23 to rotate the cable drum 28, first in a clockwise direction and then in a counter-clockwise direction.

In the counter-clockwise direction, the cable 20 will be taken up by the drum 28 to advance the traveling carriage 12 forwardly toward the front of the housing 11. When the drum 28 is rotated in a clockwise direction, the cable 21 will be taken up by the drum 28 and the carriage 12 will be retracted toward the rear end of the housing 11. Accordingly, the present invention provides a mechanically straightforward and effective means for advancing and retracting the lance tube 13 for a soot blowing operation. Moreover, the various cable movements caused by the rotation of the drum 28 will tend to rotate the pulleys around which the cables are wound and, most importantly, the carriage pulley 29. As will be described in more detail hereinbelow, the carriage pulley 29 is mechanically coupled to the input of a variable rotational drive for the lance tube 13 to effectively utilize the horizontal drive as a power source for the rotational drive of the lance tube 13.

To co-ordinate the opening and closing of the valve 16 with the working motions of the lance tube 12, a valve actuator lever 45 is pivotally mounted to the valve 16 and includes one end connected via a rod-locking linkage system 46 to a cam member 47 pivotally mounted within the housing 11 by a pin support 48. The traveling carriage 12 includes a cam actuator arm 49 provided with a cam roll bearing 50 which co-acts with the cam member 47 as the traveling carriage 12 is moved in a soot blowing operation.

At the commencement of forward movement of the traveling carriage 12, by operation of the cable drive system, the cam roll bearing 50 is received within a generally curved cam slot 51 formed within the cam member 47. The forward movement of the carriage 12 will operate to cause the cam roll bearing 50 to pivot the cam member 47 in a counter-clockwise direction about the pin support 48 whereby the rod-locking linkage system 46 is operated to pivot the valve actuator lever 45 to open the valve. Continued forward movement of the traveling carriage 12 will move the cam roll bearing 50 further to the right causing the cam 47 to be pivoted to its forwardmost "locked" position before the cam roll bearing 50 passes by the cam 47.

The valve will remain in the open position until the traveling carriage 12 is returned by the cable drive system to its rearwardmost position within the housing 11. Just prior to the arrival of the carriage 12 at the rearwardmost position, the cam roll bearing 50 will be received with the cam slot 51 (the cam being pivoted to its locked position wherein the opening of the slot 51 is in alignment with the path of travel of the cam roll bearing 50). When the cam roll bearing 50 approaches the closed end of the slot 51, it will tend to pivot the cam 47 in a clockwise direction unlocking the cam and movement the rod linkage 46 to pivot the lever 45 thereby closing the valve 16. Thus, the locking cam arrangement is operative to open the valve as the lance tube 13 starts to move the nozzle 17 into the boiler, hold the valve in the open position for the entire cleaning motion of the lance tube 13 and close the valve just as the lance tube 13 is retracted to its non-working, rearwardmost position within the housing 11.

Figure 5:
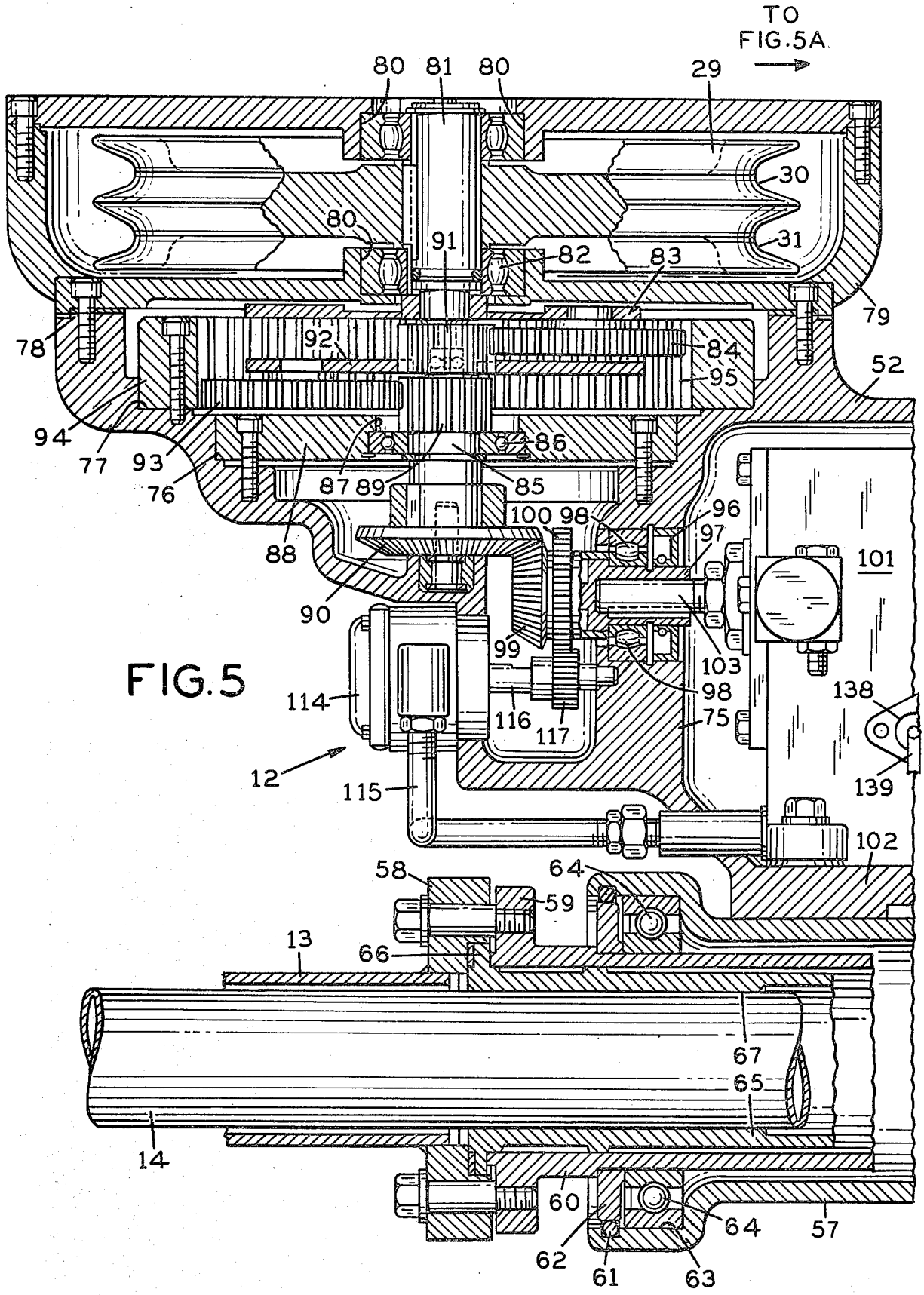
FIGS. 5 and 5A together illustrate a side cross sectional view of the traveling carriage of a soot blower incorporating the hydrostatic drive means of the present invention.
Figure 5A:
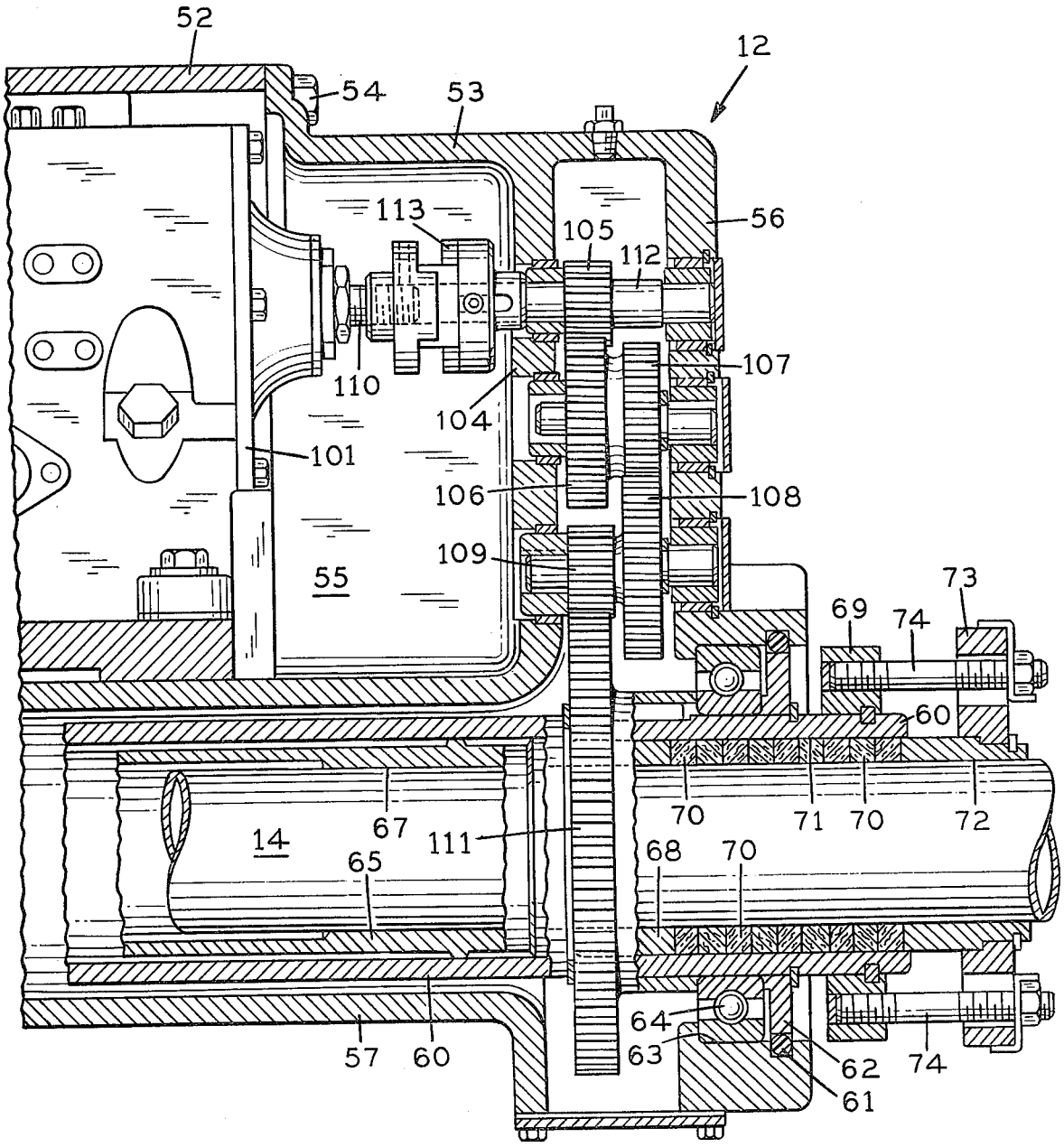

Referring now to FIGS. 5 and 5A, there is illustrated in cross section, the traveling carriage 12 of the present invention. The carriage 12 includes a main frame structure 52 and an end structure 53 mounted to an open side of the structure 52, as for example, by threaded bolts 54 to provide an internal chamber 55. The end structure 53 comprises an upper portion 56 defining the rear end of the chamber 55 and a lower portion 57 integrally associated with the upper portion 56 and forming a generally cylindrically-shaped, hollow support structure for the lance tube 13. The rear end of the lance tube 13 is welded to an annular end plate 58 which in turn is bolted to an annular flange 59 formed at the forward end of a cylindrical lance tube support 60. The lance tube support 60 is axially received within the cylindrical lower portion 57 of the end structure 53 and a set of O rings 61 and shield rings 62 are interposed between the lance tube support 60 and the internal sufaces of the cylindrical support portion 57. Moreover, the internal surfaces of the portion 57 are formed to include bearing surfaces 63 to mount a plurality of ball bearings 64 between the cylindrical portion 57 and the lance tube support 60 whereby the lance tube 13 is rotatably mounted by the traveling carriage 12.

A cylindrical sleeve 65 is received within the lance tube support 60 and is mounted in a fixed position by an annular end flange 66 which is an integral extension of the sleeve 65 received between and held by the end plate 58 and the annular end flange 59 of the lance tube support 60. The feedpipe 14 is in a close-fitting, telescoping relation with internal portions 67 of the cylindrical sleeve 65. In addition, an annular bushing 68 is interposed between the feedpipe 14 and the lance tube support 60 at the rear end of the cylindrical sleeve 67 and the end of the lance tube support 60 is provided with a gland mounting plate 69. Suitable packing material 70 is received around the feedpipe 14 and within a rearwardly extending annular recess 71 formed in the interior surface of the lance tube support 60 to provide a leak-tight seal between the lance tube support 60 and the co-axial feedpipe 14. A packing gland 72 is arranged in a co-axial relation with the end of the lance tube support 60 and is pressed against the packing material 70 by a gland follower 73 to urge the packing material 70 into an abutting relation with the annular bushing 68 to thereby maintain the packing material 70 securely in a sealing position around the feedpipe 14. Accordingly, the fluid discharged into the lance tube interior by the feedpipe 14 will not be able to leak out of the rear end of the lance tube support 60. The gland follower 73 is in turn bolted by bolts 74 to the gland mounting plate 69 to form a complete gland plate assembly. Of course, the internal portions 67 of the cylindrical sleeve 65 and the packing material 70, while securing the feedpipe 14 in a leak-tight, co-axial relation with the lance tube 13, are arranged to permit a relative sliding movement between the feedpipe 14, the packing material 70 and the cylindrical sleeve 65. Thus, the above-described structure securely mounts the lance tube 13 to the traveling carriage 12 for horizontal movements in a cleaning operation while permitting rotation of the lance tube relative to the traveling carriage 12.

Referring now to the lefthand side of the structure 52, illustrated in FIG. 5, the structure 52 is formed to provide a support structure for the carriage pulley 29 and a planetary gear system mechanically coupled to the carriage pulley 29 to provide an input for a rotational drive means for the rotatable lance tube 13. To this end, the structure 52 includes an internal web portion 75 and several upwardly facing annular land portions 76, 77, 78. A pulley housing 79 is received upon and mounted to the annular land 78 and is provided with centrally disposed bearing surfaces 80. The carriage pulley 29 is fixedly mounted to a shaft 81 which is rotatably mounted within the pulley housing 79 by means of bearings 82 mounted between the pulley shaft 81 and the bearing surfaces 80. The lower end of the pulley shaft 81 is connected to a gear support plate 83 which rotatably mounts a gear 84 whereby the axis of the gear 84 is offset from the central axis of the carriage pulley 29.

A planetary gear shaft 85 is rotatably supported by means of ball bearings 86 within a central opening 87 of an annular support plate 88 seated upon and fastened to the annular land 76. The shaft 85 includes a spur gear 89 fixedly attached to the upper end thereof and a beveled pinion 90 mounted to the lower end thereof. An intermediate gear 91 is freely rotatably mounted to the lower end of the carriage pulley shaft 81 and mounts a gear support plate 92. A gear 93 is rotatably supported by the gear plate 92 and is in meshing engagement with the gear 89.

In the operation of the soot blower, the drive cables 20, 21 of the cable drive system will tend to rotate the carriage pulley 29 as described above, whereby the gear support plate 83 will be rotated by the shaft 81 to move the gear 84 in an orbital path. A stationary, internal ring gear 94 is seated upon and fastened to the annular land 77 and includes an internal gear surface 95 which is in meshing engagement with the orbitally moving gear 84. The gear 84 is also in meshing engagement with the freely rotating gear 91 whereby the orbital motion of the gear 84 will rotate the gear 91 to rotate the gear support plate 92. The rotating gear support plate 92 in turn drives the gear 93 through an orbital motion. The gear 93 is in meshing engagement with the gear 89 of the shaft 85 whereby the orbital motion of the gear 93 will rotate the shaft 85. Accordingly, the rotating shaft 85 will rotate the beveled pinion 90.

A generally circular opening 96 is formed through the web portion 75 of the structure 52 to rotatably support a generally hollow shaft 97 by means of bearings 98. A beveled gear 99 is mounted to one end of the shaft 97 and is in meshing engagement with the beveled pinion 90. In addition, a drive gear 100 is fixedly mounted about the outer circumference of the hollow shaft 97 whereby the drive gear 100 and hollow shaft 97 are rotated by operation of the beveled pinion 90.

In accordance with a feature of the invention, hydrostatic drive 101 is mounted to a platform 102 formed integral with the structure 52 and disposed within the interior chamber 55 of the traveling carriage 12. For the preferred embodiment, an F type variable speed drive manufactured by Carter Hydraulic Works, Yorkshire, England is used as the hydrostatic drive. The hydrostatic drive 101 is provided with an input shaft 103 which is keyed into the hollow shaft 97 and an output shaft 110.

Disposed within the changer 55 is a wall member 104 integrally connected to the upper and lower portions 56, 57 of the end structure 53. Suitable openings are formed in the wall member 104 and the rear portion of the upper portion 56 to rotatably mount a series of intergaging gears 106-109. A gear 111 is fixedly mounted about the outer circumference of the lance tube support 60 and is in a meshing engagement with the gear 109. A gear 105 is mounted in meshing engagement with the gear 106 and includes a support shaft 112 which is mechanically coupled by means of a torque coupling 113 to the output shaft 110 of the hydrostatic drive 101.

Accordingly, as the beveled pinion 90 is rotated by the operation of the horizontal drive cables 20, 21, as described above, the beveled gear 99 will drive the hydrostatic drive 101 by rotating the input shaft 103 of the drive 101. The hydrostatic drive 101 will, in turn, generate a rotational drive for the output rod 110 which rotates the lance tube 13 through the gear train 105-111. The F type variable speed drive utilized in the invention includes various control means to vary the rpm of the output 110 whereby a predetermined rotational velocity for the lance tube 13 may be set when the specific horizontal velocity for the traveling carriage 12 is known. Faster or slower horizontal speeds for the traveling carriage 12 will be compensated for by appropriate adjustments to the controls of the F type drive 101.

In order to assure proper fluid pressure conditions within the drive 101, a pump 114 is mounted on the traveling carriage 12 and includes a fluid connecting tube 115 connected to the drive 101. The pump 114 is operated by an input shaft 116 which is rotated by gear 117 meshed with drive gear 100.

Pursuant to another feature of the invention, the gears 105–109 are changeable whereby, the rpm of the lance tube 13 may be varied, in addition to adjusting the controls of the F type drive, by changing the gears 105–109. Various gears may be provided to permit an adjustment to the rotation of the lance tube 13 to achieve various speed combinations from for example 8–35 rpm.

It has been found that a highly advantageous cleaning pattern is achieved by the cleaning fluid when the nozzle is rotated in the same direction during both the advancing and retracting horizontal movements of the traveling carriage 12. In the device of the present invention, the carriage pulley 29 will reverse direction when the pulling action of the cables 20, 21 is reversed by the motor 23. Thus, the rotary drive must be reversible to cancel out the effect of the change of direction of the traveling carriage 12 and maintain a unidirectional rotation for the lance tube 13.

Figure 8:
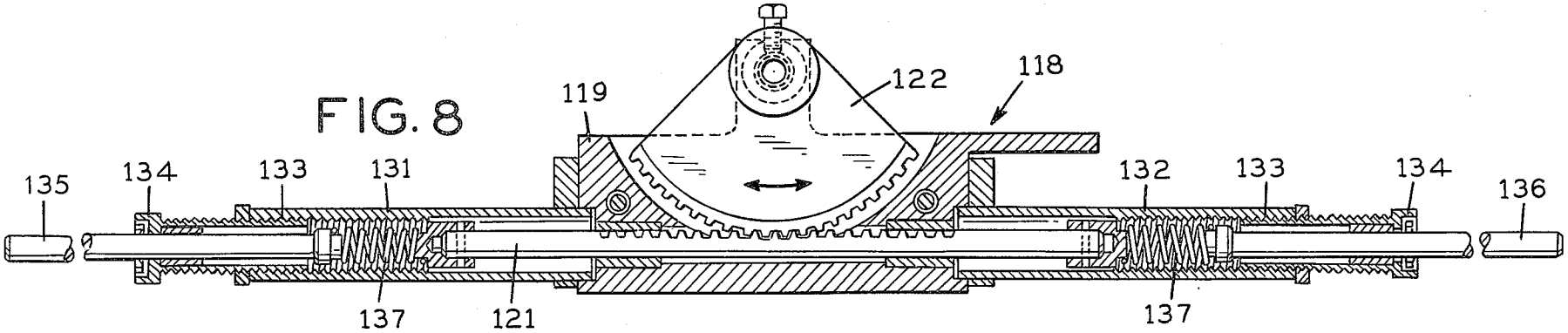
FIG. 8 is a top cross-sectional view of the reversing mechanism taken generally along line 8—8 of FIG. 7.
Figure 7:
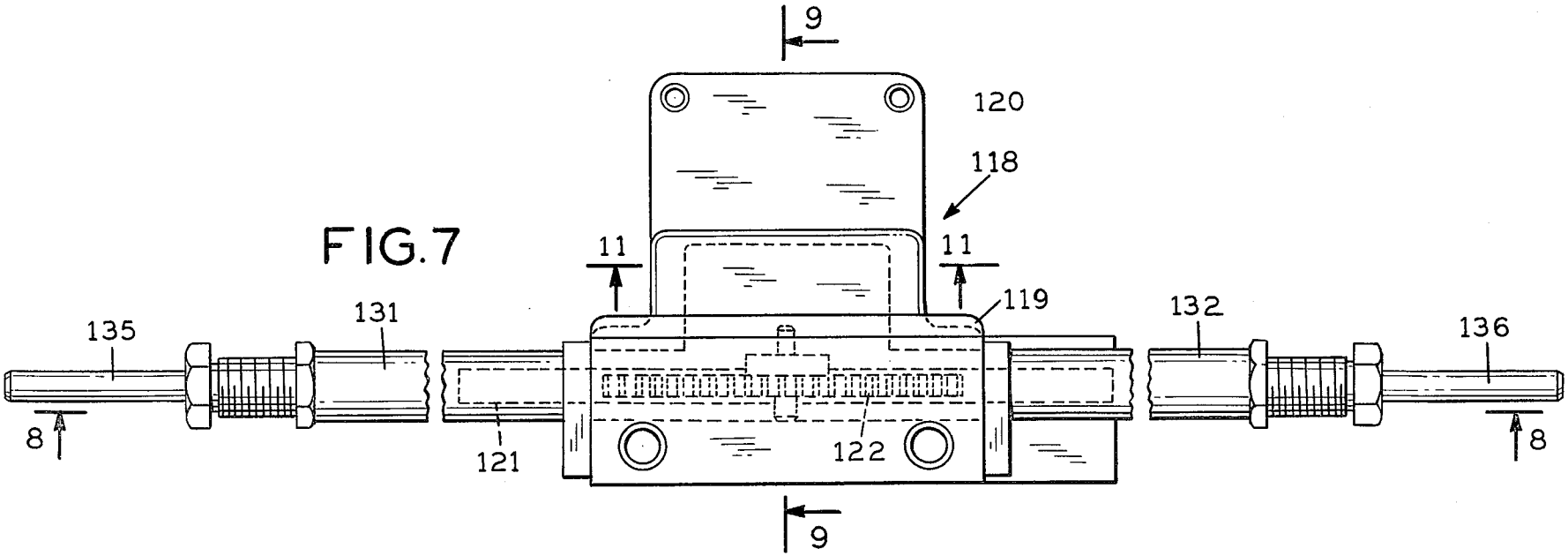
FIG. 7 is a side view of a reversing mechanism for use in connection with the hydrostatic drive according to the present invention.
Figure 9:
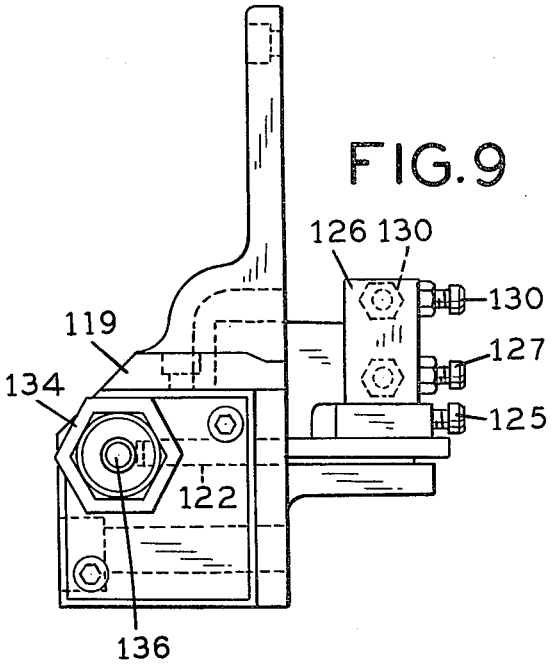
FIG. 9 is a side view of the reversing mechanism of FIG. 7.
Figure 10:
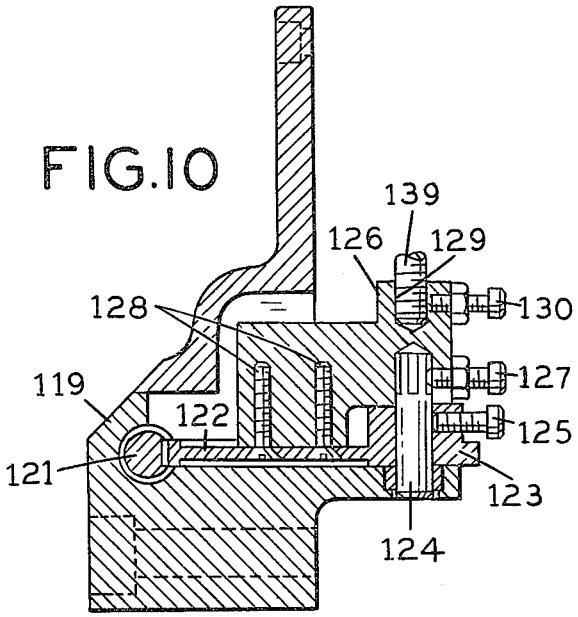
FIG. 10 is a side cross-sectional view of the reversing mechanism of FIG. 7.

To that end, the present invention includes a reversing mechanism 118 which is mounted to one side of the traveling carriage 12 (see FIG. 1). Referring now to FIGS. 7 and 8, the reversing mechanism comprises a housing 119 provided with an upwardly extending mounting plate 120 for mounting to the traveling carriage frame structure 52. A rack and pinion is arranged within the housing 119 including an axially movable rack 121 in meshing engagement with a rotatable gear segment 122. The gear segment 122 includes a hub portion 123 which is received over and secured to (by means of a set screw 125) a rotatable shaft 124 mounted in the housing 119. A coupling member 126 is also received over the rotatable shaft 124 and secured to both the shaft 124 and the gear segment 122 by set screws 127 and screws 128, respectively, as illustrated. The coupling member 126 is provided with a connecting recess 129 including a plurality of set screws 130.

A pair of sleeve portions 131, 132 are mounted to the housing 119 and receive the outer ends of the rack 121, respectively. Each sleeve portion 131, 132 includes an internal thread 133 to threadedly engage an externally threaded actuator rod support 134. Each of the actuator rod supports 134, in turn slidably mounts an actuator rod 135, 136. The internal end of each actuator rod 135, 136 is mechanically coupled to the adjacent end of the rack 121 by a coil spring 137 whereby an axial displacement of either actuator rod 135, 136 will be transmitted to the rack 121 with the coil springs 137 acting as a shock absorber.

As should be understood from FIG. 1, the reversing mechanism is mounted on the traveling carriage such that the actuating rods 135, 136 project beyond the ends of the traveling carriage 12. Thus, as the traveling carriage approaches either the forward or rearward portions of the housing, one of the actuating rods 135, 136 will engage an end wall of the housing 11 (or a suitable abutment surface mounted to the end wall, not specifically illustrated) and be axially displaced within the actuator rod support 134. The movement of one of the actuator rods 135, 136 will, of course, displace the rack 121 to rotate the gear segment 122 as indicated by the arrow in FIG. 8. Rotation of the gear segment 122 will in turn rotate the coupling member 126 including the connecting recess 129 about the shaft 124.

To advantage, the F type variable speed drive used in the preferred embodiment of the invention includes a reversing actuator which is accessible through an opening 138 provided on the side of the housing of the hydrostatic drive 101. A suitable connecting element 139 includes one end fastened to the reversing actuator 138 and another end received in the connecting recess 129 of the coupling member 126 and secured therein by means of the set screws 130. Thus, as the coupling member is rotated by the movement of the gear segment 122, the connecting element 139 will be moved to reverse the rotational direction of the output shaft 110 of the hydrostatic drive 101. During the operation of the soot blower, the traveling carriage will be moved in an advancing direction towards the forwardmost end of the housing 11 until the actuator rod 135 is displaced at the forward end of the housing 11. Advantageously, at the same time, the reversible motor 23 will be reversed to retract the traveling carriage 12 whereby the rotational direction of the carriage pulley 29 is reversed. However, the lance tube 13 will continue to rotate in the same direction as the traveling carriage 12 is retracted, inasmuch as the displacement of the actuator rod 135 reverses the direction of the hydrostatic drive to cancel out the effect of the reversal of rotational direction of the carriage pulley 29. As should be understood, actuation of the actuator rod 136 when the traveling carriage is moved to its rearwardmost position within the housing 11 will also act to reverse the direction of the hydrostatic drive 101 such that the reversal of the carriage pulley 29 when the motor 23 is operated to again advance the traveling carrage will cause the lance tube 13 to be rotated in the same direction as in the prior cleaning cycle. Therefore, the horizontal cable drive is advantageously used as the energy input for the rotational drive of the lance tube 13 with the reversing mechanism 118 operating to maintan an advantageous unidirectional rotation for the lance tube 13 throughout the entire cleaning cycle.

Figure 12:
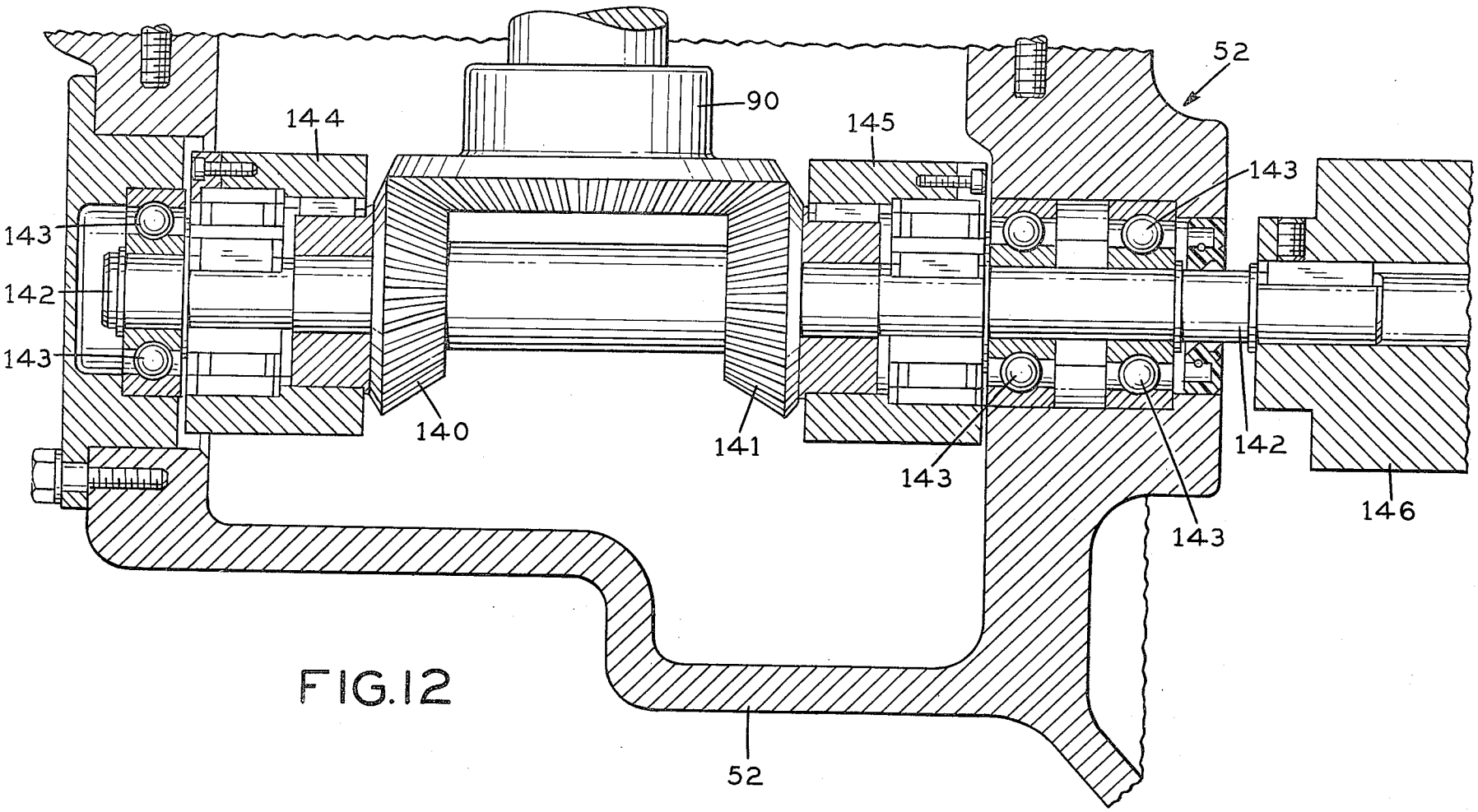
FIG. 12 is a partial side cross-sectional view of the traveling carriage of FIGS. 5 and 5A modified in accordance with another embodiment of the invention.

Referring now to FIG. 12, there is illustrated another embodiment for the mechanical coupling between the pinion 90 rotated by the carriage pulley 29 through the above described planetary system and the input drive for rotating the lance tube 13. The beveled pinion 90 is arranged in a meshing engagement with a pair of oppositely facing beveled gears 140, 141 whereby rotation of the beveled pinion 90 causes the beveled gears 140, 141 to rotate in opposite directions from one another. Each of the beveled gears 140, 141 is received over a shaft 142 which is rotatably supported within the frame structure 52 of the traveling carriage 12 by means of ball bearings 143. The beveled gears 140, 141 are each operatively connected to a complementary cam clutch 144, 145, respectively, which controls the mechanical rotational relationship between the respective beveled gear 140, 141 and the shaft 142, as will appear. To advantage, the cam clutches 144, 145, each comprise a commercially available Morse clutch Model NFS-15. The Morse clutches are self-actuating clutch mechanisms arranged to permit a free-wheeling rotation of the complementary beveled gear 140, 141 in one rotational direction and a torque transmitting relationship between the shaft 142 and the gear when the beveled gear 140, 141 is rotated in the opposite direction. The cam clutches 144, 145 are mounted within the frame structure 52 of the traveling carriage 12 such that when one of the cam clutches 144, 145 is operative to provide a free-wheeling association between the complementary beveled gear 140, 141 and the shaft 142, the other cam clutch 144, 145 is operative to provide the torque transmitting relationship between the complementary beveled gear 140, 141 and the shaft 142.

In this manner, the rotational direction of the shaft 142 will remain constant irrespective of the rotational direction of the beveled pinion 90. For example, when the beveled pinion 90 is rotating in the counter-clockwise direction, as viewed from below, the beveled gear 140 will be rotated in the clockwise direction and the beveled gear 141 will be rotated in the counter-clockwise direction, as viewed from the right. The cam clutch 144 may be arranged such that the beveled gear 140 is in a free-wheeling rotation in the clockwise direction and the cam clutch 145 arranged to provide the torque transmitting relationship between the beveled gear 141 and the shaft 142 whereby the shaft 142 will be driven in the counter-clockwise direction. When the horizontal direction of the traveling carriage 12 is reversed, the beveled gear 90, of course, will be rotated in the clockwise direction such that the beveled gear 140 is rotated in the counter-clockwise direction and the beveled gear 141 rotated in the clockwise direction. Now, the operation of the cam clutches 144, 145 will be opposite than that in the previous example and the now counter-clockwise moving beveled gear 140 will be in the torque transmitting relation to the shaft 142 to continue the counter-clockwise rotation of the shaft 142 despite the reversal of the direction of the beveled pinion 90. Of course, in the latter example, the beveled gear 141 will be free-wheeling.

Figure 11:
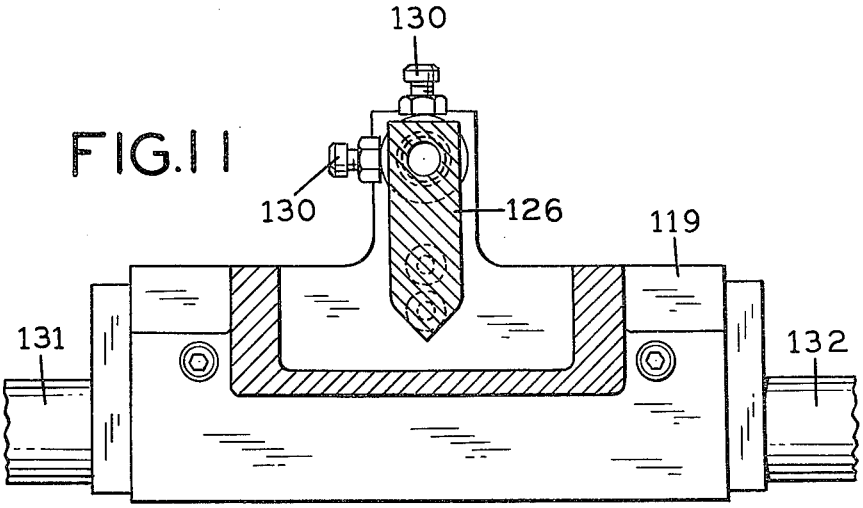
FIG. 11 is a top partial cross-sectional view of the reversing mechanism taken generally along line 11—11 of FIG. 7.

In the embodiment of FIG. 12, the unidirectional shaft 142 is keyed into a torque coupling element 146 which may be either connected to the input shaft 102 of the hydrostatic drive 102 or directly coupled to the shaft 112 as the input drive for the gear train 105–109. In the latter case, the gear train will be unidirectionally driven by the shaft 142 and all rpm adjustments for the lance tube 13 are made by changes in the gear train. In the former case, the reversing mechanism of FIGS. 7–10 is replaced in function by the coupling of FIG. 11 inasmuch as the input to the hydrostatic drive 101 will be unidirectional during the entire cleaning cycle.

The present invention therefore provides effective power utilization in simultaneously driving the traveling carriage and rotating the lance tube. The cable drive is arranged to controllably advance and retract the traveling carriage while being coupled to the traveling carriage whereby cable movements generate a rotary input drive for rotating the lance tube. The variable rotary drive mechanism may be conveniently adjusted to rotate the lance tube at a preferred rpm notwithstanding the particular horizontal speed of operation selected for the traveling carriage. Moreover, the novel "reversing" mechanisms provide an independent control for the rotational direction of the lance tube whereby the lance tube rotation may be kept unidirectional during the entire cleaning cycle. Thus, the effective and efficient power utilization is accomplished without any sacrifice in nozzle movement control to achieve excellent boiler cleaning.

The above-described preferred embodiments of the invention are meant to be representative only as certain changes therein may be made by persons skilled in the art without departing from the clear teachings of the invention. Accordingly, reference should be made to the following appended claims in determining the full scope of the invention.

I claim:

1. In a soot blower of the long retracting type including a traveling carriage rotatably supporting a lance tube and movable in an advancing and retracting direction along a predetermined horizontal path of travel between a forwardmost working position and a rearwardmost non-working position, means to impart a horizontal motion to the traveling carriage and a rotational motion to the lance tube, which comprises (a) a motor means, (b) horizontal drive means associated with said motor means whereby operation of the motor means energizes the horizontal drive means to advance and retract the traveling carriage along the predetermined horizontal path of travel, and (c) a rotary drive means mounted on said traveling carriage for rotating said lance tube, (d) said rotary drive means being mechanically coupled to said motor means through said horizontal drive means whereby operation of the motor means provides a driving input for the rotary drive means, (e) said rotary drive means including independent control means for controlling the rotational velocity and direction of rotation of the lance tube independently of the speed and direction of travel of the traveling carriage.

2. The means to impart horizontal motion to said traveling carriage and rotational motion to the lance tube according to claim 1, further characterized by (a) said horizontal drive means comprising a cable means operatively suspended between the motor means and the traveling carriage whereby operation of the motor means moves the cable means to advance and retract the traveling carriage, (b) said rotary drive means being mechanically coupled to said cable means whereby cable movement during operation of the motor means provides an input drive for said rotary drive means.

3. The means to impart horizontal motion to said traveling carriage and rotational motion to the lance tube according to claim 1, further characterized by (a) said lance tube including a gear element fixedly associated therewith, (b) said rotary drive means including a gear train mounted within said traveling carriage and mechanically coupling the horizontal drive means to the gear element associated with said lance tube whereby the gear train transmits the mechanical energy of the horizontal drive means to the gear element to thereby rotate the lance tube, (c) said gear train including at least one selectively changeable gear element whereby the rotational velocity imparted to the lance tube may be adjusted.

4. The means to impart horizontal motion to said traveling carriage and rotational motion to the lance tube according to claim 3, further characterized by (a) a drive element mounted on said traveling carriage, (b) said drive element being mechanically associated with said horizontal drive means whereby operation of the horizontal drive means to impart advancing and retracting horizontal motions to the traveling carriage acts to rotate said drive element, (c) said drive element being mechanically coupled to a torque transmitting device, (d) said torque transmitting device including a unidirectionally rotating output element, and (e) said unidirectionally rotating output element being in a driving connection to said gear train whereby the rotational direction of the rotating lance tube is independent of the direction of travel of the traveling carriage.

5. The means to impart horizontal motion to said traveling carriage and rotational motion to the lance tube according to claim 4, further characterized by (a) said torque transmitting device including at least two oppositely facing gear elements with each of said gear elements being in a driving engagement with said rotating drive element whereby rotation of said rotating drive element causes said gear elements to be rotated in rotational directions opposite from one another, (b) each of said gear elements being rotatably mounted upon said unidirectionally rotating output element and operatively connected to a complementary self-actuating clutch means, (c) each of said self-actuating clutch means being operative to provide a torque transmitting relation between the complementary gear element and the unidirectionally rotating output element for one rotational direction of said gear element and a free-wheeling rotation of the complementary gear element with respect to the unidirectionally rotating output element in the opposite direction, (d) said self-actuating clutch means being arranged and configured with respect to the oppositely facing gear elements whereby when one of the self-actuating clutch means is operative to provide a torque transmitting relation between the complementary gear element and the unidirectionally rotating output element, the other self-actuating clutch means will provide said free-wheeling rotation for its complementary gear element, (e) whereby the gear elements and complementary self-actuating clutch means operate to transmit the torque of the rotating drive element in the same rotational direction to the unidirectionally moving output element for any rotational direction of the rotating drive element thereby controlling the rotational direction of the lance tube independently of the direction of travel of the traveling carriage.

6. The means to impart horizontal motion to said traveling carriage and rotational motion to the lance tube according to claim 5, further characterized by (a) said rotating drive element comprising a beveled pinion gear, and (b) said gear elements each comprising a beveled gear in a meshing engagement with said beveled pinion gear.

7. The means to impart horizontal motion to said traveling carriage and rotational motion to the lance tube according to claim 2, further characterized by (a) a pulley rotatably mounted on said traveling carriage, (b) said cable means being wound about said pulley whereby cable movement tends to rotate the pulley, and (c) said pulley being mechanically coupled to said rotary drive means.

8. The means to impart horizontal motion to said traveling carriage and rotational motion to the lance tube according to claim 2, further characterized by (a) a hydrostatic drive means mounted on said traveling carriage and including an input drive and an output element, (b) said cable means being mechanically coupled to said input drive, (c) said output element being mechanically coupled to said lance tube, (d) said hydrostatic drive means including control means to control the velocity and direction of rotation of the output element.

9. The means to impart horizontal motion to said traveling carriage and rotational motion to the lance tube according to claim 8, further characterized by (a) a reversing mechanism mounted on said traveling carriage and being mechanically coupled to said control means of the hydrostatic drive, (b) said reversing mechanism being operative to operate the control means to reverse the operation of the hydrostatic drive at predetermined times during movement of the traveling carriage along the path of travel.

10. The means to impart horizontal motion to said traveling carriage and rotational motion to the lance tube according to claim 9, further characterized by (a) said reversing mechanism including a rack and pinion means associated with the traveling carriage, (b) a pair of actuator elements mounted on the traveling carriage and being operatively associated with the rack and pinion means whereby displacement of the actuator elements operate the rack and pinion means, and (c) means on the soot blower to engage said actuator elements at predetermined points on the path of travel, (d) said rack and pinion means being mechanically coupled to the control means of the hydrostatic drive.

11. The means to impart horizontal motion to said traveling carriage and rotational motion to the lance tube according to claim 10, further characterized by (a) said means on the soot blower comprising the front and rear walls of a housing.

12. In a soot blower of the long retracting type including a traveling carriage rotatably supporting a lance tube and movable in an advancing and retracting direction along a predetermined horizontal path of travel between a forwardmost working position and a rearwardmost non-working position, means to impart a horizontal motion to the traveling carriage and a rotational motion to the lance tube, which comprises (a) horizontal drive means to advance and retract the traveling carriage along the predetermined horizontal path of travel whereby the traveling carriage moves along the path of travel first in a forward direction to the forwardmost working position and then in a rearward direction to the rearwardmost non-working position, and (b) a rotary drive means mounted on said traveling carriage for rotating the lance tube, (c) said rotary drive means being mechanically coupled to the horizontal drive means such that the traveling motion of the traveling carriage during its forward and rearward movement along the path of travel causes a driving input to the rotary drive means, (d) said rotary drive means including independent velocity and direction control means for controlling the rotational velocity and direction of rotation of the lance tube independently of the speed and direction of travel of the traveling carriage.

13. The means to impart horizontal motion to said traveling carriage and rotational motion to the lance tube according to claim 12, further characterized by (a) said rotary drive means including a gear train for transmitting the mechanical energy of the input to the rotary drive means to the lance tube, and (b) said gear train including at least one selectively changeable gear element whereby the rotational velocity of the lance tube may be controlled.

14. The means to impart horizontal motion to said traveling carriage and rotational motion to the lance tube according to claim 12 or 13, further characterized by (a) said control means including a torque transmitting device provided with a unidirectionally rotating output element, (b) said unidirectionally rotating output element being associated with said rotary drive means whereby the rotational direction of the rotating lance tube is independent of the direction of travel of the traveling carriage.

15. The means to impart horizontal motion to said traveling carriage and rotational motion to the lance tube according to claim 14, further characterized by (a) said torque transmitting device including at least two oppositely facing gear elements with each of said gear elements being coupled to the driving input to the rotary drive means whereby said gear elements are rotated in rotational directions opposite from one another, (b) each of said gear elements being rotatably mounted upon said unidirectionally rotating output element and operatively connected to a complementary self-actuating clutch means, (c) each of said self-actuating clutch means being operative to provide a torque transmitting relation between the complementary gear element and the unidirectionally rotating output element for one rotational direction of said gear element and a free-wheeling rotation of the complementary gear element with respect to the unidirectionally rotating output element in the opposite direction, (d) said self-actuating clutch means being arranged and configured with respect to the oppositely facing gear elements whereby when one of the self-actuating clutch means is operative to provide a torque transmitting relation between the complementary gear element and the unidirectionally rotating output element, the other self-actuating clutch means will provide said free-wheeling rotation for its complementary gear element, (e) whereby the gear elements and complementary self-actuating clutch means operate to transmit the torque of the driving input to the rotary drive means in the same rotational direction to the unidirectionally moving output element for any rotational direction of the driving input to the rotary drive means thereby controlling the rotational direction of the lance tube independently of the direction of travel of the traveling carriage.

16. The means to impart horizontal motion to said traveling carriage and rotational motion to the lance tube according to claim 12, further characterized by (a) said rotary drive means including a hydrostatic drive means including an output element, (b) said output element being mechanically coupled to said lance tube, and (c) said hydrostatic drive means including said independent velocity and direction control means to control the velocity and direction of the output element.

17. The means to impart horizontal motion to said traveling carriage and rotational motion to the lance tube according to claim 16, further characterized by (a) a reversing mechanism being mechanically coupled to said control means of the hydrostatic drive means, (b) said reversing mechanism being operative to operate the control means to reverse the operation of the hydrostatic drive means at predetermined times during movement of the traveling carriage along the path of travel.

18. The means to impart horizontal motion to said traveling carriage and rotational motion to the lance tube according to claim 17, further characterized by (a) said reversing mechanism including a rack and pinion means associated with the traveling carriage, (b) a pair of actuator elements mounted on the traveling carriage and being operatively associated with the rack and pinion means whereby displacement of the actuator elements operate the rack and pinion means, and (c) means on the soot blower to engage said actuator elements at predetermined points on the path of travel, (d) said rack and pinion means being mechanically coupled to the control means of the hydrostatic drive.

19. In a soot blower of the long retracting type including a traveling carriage rotatably supporting a lance tube and moving in an advancing and retracting direction along a predetermined horizontal path of travel and including means to impart a horizontal motion to the traveling carriage and a rotary drive means for rotating the lance tube, a drive gear assembly for mechanically coupling said horizontal motion means to said rotary drive means, which comprises (a) an input drive means whereby operation of said means to impart a horizontal motion to the traveling carriage rotates said input drive means in accordance with the direction of travel of the traveling carriage, (b) a unidirectionally rotating output element coupling said drive gear assembly to said rotary drive means whereby the unidirectional rotation of said output element causes rotation of said lance tube, (c) mechanical coupling means mechanically interconnecting said input drive means and said unidirectionally rotating output element whereby the rotational direction of the output element is unidirectional and independent of the direction of travel of the traveling carriage.

20. The drive gear assembly according to claim 19, further characterized by (a) said mechanical coupling means including at least two gear elements with each of said gear elements being driven by the input drive means whereby said gear elements are rotated in rotational directions opposite from one another, (b) each of said gear elements being rotatably mounted upon said unidirectionally rotating output element and operatively connected to a complementary self-actuating clutch means, (c) each of said self-actuating means being operative to provide a torque transmitting relation between the complementary gear element and the unidirectionally rotating output element for one rotational direction of said gear element and a free-wheeling rotation of the complementary gear element with respect to the unidirectionally rotating output element in the opposite direction, (d) said self-actuating clutch means being arranged and configured with respect to the gear elements whereby when one of the self-actuating clutch means is operative to provide a torque transmitting relation between the complementary gear element and the unidirectionally rotating output element, the other self-actuating clutch means will provide said free-wheeling rotation for its complementary gear element, (e) whereby the gear elements and complementary self-actuating clutch means operate to transmit the torque of the input drive means in the same rotational direction to the unidirectionally moving output element for any rotational direction of the input drive means thereby controlling the rotational direction of the lance tube independently of the direction of travel of the traveling carriage.

21. In a soot blower of the long retracting type including a traveling carriage rotatably supporting a lance tube and movable in an advancing and retracting direction along a predetermined horizontal path of travel between a forwardmost working position and a rearwardmost non-working position, means to impart a horizontal motion to the traveling carriage and a rotational motion to the lance tube, which comprises (a) horizontal drive means to advance and retract the traveling carriage along the predetermined horizontal path of travel, (b) a rotary drive means mounted on said traveling carriage for rotating the lance tube and being mechanically coupled to said horizontal drive means such that the traveling motion of the traveling carriage during its forward and rearward movement along the path of travel causes a driving input to the rotary drive means, (c) said rotary drive means being mechanically coupled to the lance tube, (d) means for controlling said rotary drive means whereby the rotary direction of said lance tube may be controlled independently of the direction of travel of the traveling carriage, (e) a reversing mechanism being mechanically coupled to the control means associated with the rotary drive means, (f) said reversing mechanism being operative to control the rotational direction of said lance tube at predetermined times during movement of the traveling carriage along the path of travel.

22. The means to impart horizontal motion to said traveling carriage and rotational motion to the lance tube according to claim 21, further characterized by (a) said reversing mechanism including a rack and pinion means, (b) a pair of actuator elements mounted on the traveling carriage and being operatively associated with the rack and pinion means whereby displacement of the actuator elements operate the rack and pinion means, and (c) means on the soot blower to engage said actuator elements at predetermined points on the path of travel, (d) said rack and pinion means being mechanically coupled to the control means of the rotary drive means.

23. In a soot blower of the long retracting type including a traveling carriage rotatably supporting a lance tube and movable in an advancing and retracting direction along a predetermined horizontal path of travel between a forwardmost working position and a rearwardmost non-working position, means to impart a horizontal motion to the traveling carriage and a rotational motion to the lance tube, which comprises (a) a reversible, rotatable drum-like element associated with said soot blower and being mounted adjacent the path of travel and generally midway between said forwardmost and rearwardmost positions, (b) a pulley means rotatably mounted on said traveling carriage, (c) cable means operatively associated with each of and extending between said reversible, rotatable drum-like element and said pulley means, (d) reversible motor means mechanically coupled to said reversible, rotatable drum-like element whereby operation of said reversible motor means acts to rotate said drum-like element to impart linear motion to the cable means thereby advancing and retracting said traveling carriage, (e) rotary drive means mounted on said traveling carriage to rotate the lance tube, (f) said pulley means and said cable means being arranged and configured with respect to one another whereby the linear motion imparted to the cable means upon rotation of the drum-like element causes the cable means to rotate the pulley means, (g) said pulley means being mechanically coupled to said rotary drive means whereby rotation of the pulley means provides a driving input for the rotary drive means.

24. In a soot blower of the long retracting type including a longitudinally extending housing and a traveling carriage movably supported within said housing for movement in an advancing and retracting direction along a predetermined horizontal path of travel defined by said housing between a forwardmost working position and a rearwardmost non-working position, means for movably supporting said traveling carriage within said housing which comprises (a) said housing including two vertically disposed side walls, (b) each of said side walls being arranged and configured to include a track-forming bend extending longitudinally along substantially the full length of said side wall, (c) said traveling carriage including a plurality of rollers rotatably mounted on said traveling carriage, (d) each of said rollers being formed to include a generally concave surface arranged and configured to mate with a complementary track-forming bend to movably support the traveling carriage within the housing.

25. In a soot blower of the long retracting type including a traveling carriage rotatably supporting a lance tube and movable in an advancing and retracting direction along a predetermined horizontal path of travel between a forwardmost working position and a rewardmost non-working position, means to impart a rotational motion to the lance tube, which comprises (a) a rotary drive means mounted on said traveling carriage for rotating said lance tube, and (b) mechanical means at least partially mounted remote from said traveling carriage to provide a driving input for said rotary drive means, (c) said rotary drive means including independent velocity and direction control means for controlling the rotational velocity and direction of rotation of the lance tube indpendently of the speed and direction of travel of the traveling carriage.

26. The means to impart rotational motion to the lance tube according to claim 25, further characterized by (a) horizontal drive means to advance and retract the traveling carriage along said predetermined horizontal path of travel, and (b) said mechanical means at least partially mounted remote from said traveling carriage including said horizontal drive means and means mechanically coupling said rotary drive means to said horizontal drive means whereby operation of said horizontal drive means causes a driving input to the rotary drive means.

* * * * *